US006985691B2

(12) United States Patent
Kodera et al.

(10) Patent No.: US 6,985,691 B2
(45) Date of Patent: Jan. 10, 2006

(54) TRANSPARENT SUBSTRATE IMAGE FORMING METHOD AND LAMINATED IMAGE-RECORDING MEDIUM

(75) Inventors: Tetsuro Kodera, Ashigarakami-gun (JP); Naoyuki Egusa, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/664,927

(22) Filed: Sep. 22, 2003

(65) Prior Publication Data

US 2004/0057760 A1 Mar. 25, 2004

(30) Foreign Application Priority Data

Sep. 20, 2002 (JP) ..... 2002-276027
Aug. 6, 2003 (JP) ..... 2003-287430

(51) Int. Cl.
*G03G 15/20* (2006.01)

(52) U.S. Cl. ..... 399/341; 399/342

(58) Field of Classification Search ..... 399/341, 399/320, 328, 342, 335, 336
See application file for complete search history.

(56) References Cited

U.S. PATENT DOCUMENTS 3,987,757 A * 10/1976 Leising ..... 118/641
5,281,504 A * 1/1994 Kanbayashi et al. ..... 430/99
5,784,679 A * 7/1998 Schlueter et al. ..... 399/335

FOREIGN PATENT DOCUMENTS

JP 53134444 A * 11/1978
JP A 09-171278 6/1997

* cited by examiner

*Primary Examiner*—Quana Grainger
(74) *Attorney, Agent, or Firm*—Oliff & Berridge, PLC

(57) ABSTRACT

The present invention provides an image forming method comprising: laminating a plurality of toner layers on the surface of a transparent substrate electrophotographically; subjecting the plural toner layers to a primary fixing in a primary fixing step; and forming a fixed image by applying a secondary fixing in a secondary fixing step. The secondary fixing step is carried out under reduced pressure.

20 Claims, 3 Drawing Sheets

TRANSPARENT SUBSTRATE IMAGE FORMING METHOD AND LAMINATED IMAGE-RECORDING MEDIUM

CROSS-REFERENCE TO RELATED APPLICATION

This application claims priority under 35 USC 119 from Japanese patent Application Nos. 2002-276027 and 2003-287430, the disclosures of which are incorporated by reference herein.

BACKGROUND OF THE INVENTION

1. Field of the Invention

The present invention relates to an image-recorded medium on which images capable of visual recognition by both reflection light and transmission light are recorded, particularly to an image forming method and image-recorded medium that provide highly reliable recorded images which do not show changes with time under various environments.

2. Description of the Related Art

With recent developments of image forming technologies, methods for cheaply forming a large quantity of images having the same quality by employing various printing methods such as intaglio printing, letter-press printing, planographic printing, gravure printing and screen printing, have been known in the art.

For example, automobile meter panels are required to have both characteristics of light screening property and light transmitting property, and the screen printing has been employed from the technical point of view.

Recently, production of the automobile meter panels by applying electrophotographic technologies, has been attempted. By applying the electrophotographic technologies, the preparation and management of screen meshes, which have been required in screen printing, becomes unnecessary; moreover, minor changes of the meter panel can be easily made by changing electronic information, which largely reduces production cost in small lot production; further, repetition of processes such as printing and drying becomes unnecessary, which largely improves productivity.

With respect to laminates obtained by laminating recorded members such as identification cards and other cards with a transparent resin film, electrophotographic copy machines that produce and laminate the recorded medium by the electrophotographic process are proposed (for example Japanese Patent Application Laid-Open (JP-A) No. 9-171278)).

In general, recorded images having both characteristics of screening and transmitting lights are required to have a proportion of acceptable products of almost 100% from the view point of mass production. However, complete light screening property cannot be attained by direct application of conventional electrophotographic technologies: many light transmitting holes called pin-holes are generated when electrophotographic technologies are employed. Accordingly, such high proportion of acceptable products cannot be obtained by conventional electrophotography.

For solving these problems, the following two countermeasures are essential for applying the electrophotographic process:

(1) when images are recorded by laminating four toner layers, at least two of the layers are composed of black toners; and (2) the transferred mass per area (TMA) of toner at light screening portions are at least 2.1 mg/cm$^2$.

A light screening ratio having a transmission density of 3.5 or more may be achieved by the two countermeasures. However, if the countermeasures are employed in usual electrophotographic systems, sufficient image quality cannot be obtained: the TMA twice as high as that of conventional systems causes problems such as image breaking caused by transfer failures or blisters (foaming in the fixing process). In other words, these transfer failures and blisters cause defects called pin-holes when the recorded image is evaluated with the transmission light.

In order to prevent the generation of pin-holes, measures are employed. For example, the secondary transfer bias is optimized for avoiding transfer failure, or only the toner on the uppermost surface of the toner layer is temporary fixed on a medium to an extent not to cause image slippage then secondarily fixed in an oven in a non-contact manner for preventing blisters.

For example, meter panels equipped in an automobile are required to have long-term reliability in an environment where the temperature in a cabin in midsummer is supposed to be 80 to 100° C. Since this temperature is higher than the glass transition point of the toner, the toner is fluidized by heat, so that the recorded images can no longer kept intact.

Thus, lamination after the second fixing is essential for protecting the recorded image. Only panel portions are cut from the meter panel precursor produced as described above by a cutout device and attached to a panel frame to produce a meter panel.

However, when the toner layer is not sufficiently degassed during the secondary fixing in an oven, the air in toner layers is expanded to put away the softened toner. The portions of the toner are grown into voids that transmit the light to deteriorate the reliability of the recorded images.

SUMMARY OF THE INVENTION

The object of the present invention is to solve the conventional technical problems.

More specifically, it is an object of the present invention to provide an image forming method by which a recorded image having both characteristics of light screening property and light transmission property as in a meter panel and not deteriorated under a high temperature environment, is obtained. It is another object of the invention to provide an image-recorded medium having highly reliable recorded images.

The first aspect of the invention is to provide an image forming method (A) comprising:

laminating a plurality of toner layers on a surface of a transparent substrate electrophotographically;

subjecting the plural toner layers to a primary fixing in a primary fixing step; and subjecting the plural toner layers to a secondary fixing in a secondary fixing step to form a fixed image, wherein the secondary fixing step is carried out under reduced pressure.

The second aspect of the invention is to provide the image forming method (A), wherein the secondary fixing step is carried out in a non-contact manner.

The third aspect of the invention is the image forming method (A), wherein the secondary fixing step is carried out at 100 to 140° C.

The fourth aspect of the invention is to provide the image forming method (A), wherein the secondary fixing step is carried by using heated rolls.

The fifth aspect of the invention is to provide the image forming method (B), wherein the plural toner layers are heated under atmospheric pressure before the secondary fixing under reduced pressure in the secondary fixing step is carried out.

The sixth aspect of the invention is to provide the image forming method (A), wherein the primary fixing step is carried put at a primary fixing temperature of 100 to 145° C.

The seventh aspect of the invention is to provide the image forming method (A), wherein the secondary fixing step is carried by using heated rolls, and a temperature of the heated rolls in the secondary fixing step is from 120 to 170° C.

The eighth aspect of the invention is to provide the image forming method (A), wherein the plural toner layers are heated under atmospheric pressure before the secondary fixing under reduced pressure in the secondary fixing step is carried out, and the plural toner layers are heated in a non-contact manner in an oven.

The ninth aspect of the invention is to provide the image forming method (A), wherein the plural toner layers are heated under atmospheric pressure before the secondary fixing under reduced pressure in the secondary fixing step is carried out, and the plural toner layers are heated at 80 to 140° C.

The tenth aspect of the invention is to provide an image forming method (B) comprising:

laminating a plurality of toner layers on a surface of a transparent substrate electrophotographically;

subjecting the plural toner layers to a primary fixing in a primary fixing step; and subjecting the plural toner layers to a secondary fixing in a secondary fixing step to form a fixed image, wherein the secondary fixing step is carried out under reduced pressure, and a degree of vacuum of the reduced pressure is no more than $1\times10^4$ Pa.

The eleventh aspect of the invention is to provide the image forming method (B), wherein the secondary fixing step is carried out in a non-contact manner.

The twelfth aspect of the invention is the image forming method (B), wherein the secondary fixing step is carried out at 100 to 140° C.

The thirteenth aspect of the invention is to provide the image forming method (B), wherein the secondary fixing step is carried out by using heated rolls.

The fourteenth aspect of the invention is to provide the image forming method (B), wherein the plural toner layers are heated under atmospheric pressure before the secondary fixing under reduced pressure in the secondary fixing step is carried out.

The fifteenth aspect of the invention is to provide the image forming method (B), wherein the primary fixing step is carried out at a primary fixing temperature of 100 to 145° C.

The sixteenth aspect of the invention is to provide the image forming method (B), wherein the secondary fixing step is carried out by using heated rolls, and a temperature of the heated rolls in the secondary fixing step is from 120 to 170° C.

The seventeenth aspect of the invention is to provide the image forming method (B), wherein the plural toner layers are heated under atmospheric pressure before the secondary fixing under reduced pressure in the secondary fixing step is carried out, and the toner layers are heated in a non-contact manner in an oven.

The eighteenth aspect of the invention is to provide the image forming method (B), wherein the plural toner layers are heated under atmospheric pressure before the secondary fixing under reduced pressure in the secondary fixing step is carried out, and the toner layers are heated at 80 to 140° C.

The nineteenth aspect of the invention is to provide an image-recorded medium formed by the steps comprising:

laminating a plurality of toner layers on a surface of a transparent substrate electrophotographically;

fixing the plural toner layers to form a fixed image; and laminating the fixed image with a transparent laminate film, wherein the fixed image is formed by the image forming method (A).

The twentieth aspect of the invention is to provide an image-recorded medium produced by laminating a plurality of toner layers on a surface of a transparent substrate electrophotographically;

fixing the plural toner layers to form a fixed image; and laminating the fixed image with a transparent laminate film, wherein the fixed image is formed by the image forming method (B).

DETAILED DESCRIPTION OF THE INVENTION

The present invention will be described in detail hereinafter.

The image forming method of the invention comprises:

laminating a plurality of toner layers on a surface of a transparent substrate electrophotographically;

primary fixing the plural toner layers; and secondary fixing the toner layers to form a fixed image, wherein the secondary fixing step is carried out under reduced pressure.

The image-recorded medium of the invention is formed by the steps comprising:

laminating a plurality of toner layers on a surface of a transparent substrate electrophotographically;

forming a fixed image by fixing the plural toner layers; and laminating the fixed image with a transparent laminate film, wherein the fixed image is formed by the image forming method as described above.

The plural toner layers are temporarily fixed (primary fixing) at a low temperature followed by secondary fixing under reduced pressure, in place of usual one-step fixing at a high temperature. Therefore, generation of air bubbles in the toners layer during the fixing process are reduced, and even when vacant spaces are generated in the fixed image after secondary fixing, air is not present in the spaces. As a result, no blisters and voids are generated, so that an image-recorded medium being excellent in the light screening property and light transmitting property can be obtained.

Figure 1:
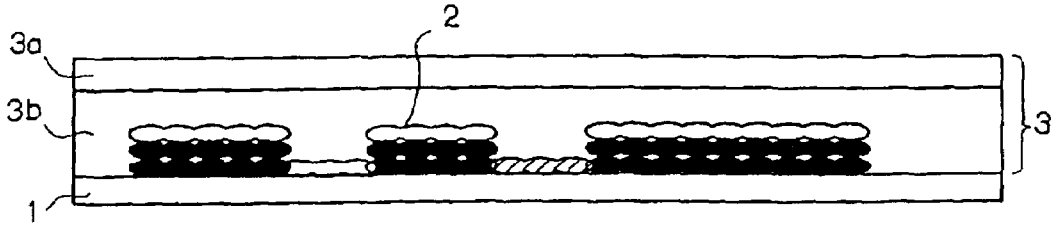
FIG. 1 is a cross section of the construction showing an example of the image-recorded medium of the present invention.

FIG. 1 is an enlarged cross sectional view showing an example of the image-recorded medium of the invention. As shown in FIG. 1, the image-recorded medium comprises a substrate 1, fixed images 2 fixed on the surface of the substrate, and a laminate film 3 covering the fixed images 2.

Figure 2:
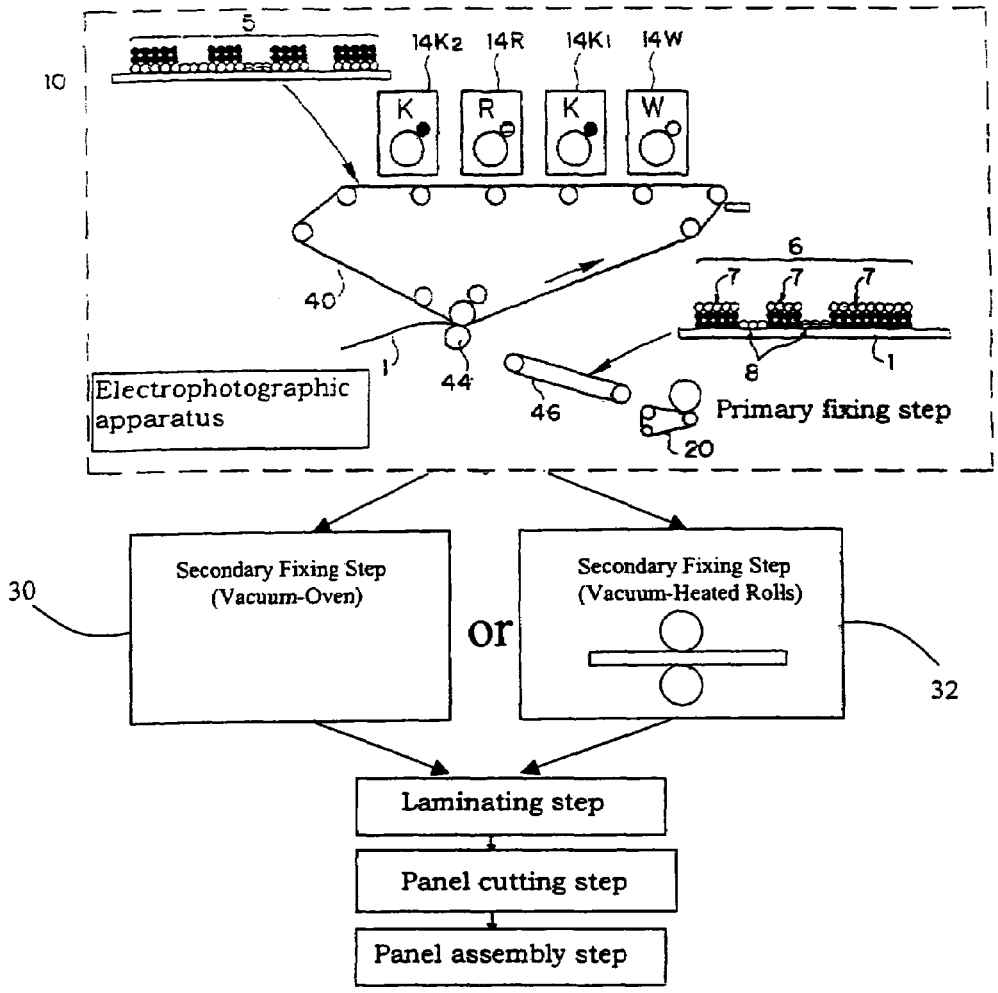
FIG. 2 is a schematic diagram illustrating the production process of the image-recorded medium and the display panel.

FIG. 2 illustrates the image forming method of the invention and a flow sheet for producing an image-recorded medium and a meter panel using the same.

A plurality of toner layers are formed on the surface of the substrate 1 (toner layer forming step) by using an electrophotographic apparatus (an image forming apparatus of the invention) 10; the toner image is primarily fixed (primary fixing step) with a fixing device 20; the toner image is secondarily fixed in an oven 30 (secondary fixing step). Subsequently, the surface of the fixed image is laminated with a laminate film for protecting the fixed image surface to produce an image-recorded medium. The laminated image-recorded medium is formed into a panel member in a panel cutting step, and finally used to make a final product such as an automobile panel meter in a panel assembling step. The image forming method of the invention comprises the toner layer forming step, primary fixing step and secondary fixing step.

The image forming method of the invention will be described at first.

<Image Forming Method>

It is essential in the invention to perform the secondary fixing step in a reduced pressure environment after the primary fixing step. Such image forming process permits the toner layer to be degassed before completely fixed in the secondary fixing step. Consequently, generation of voids due to expansion of air during the use at a high temperature may be prevented when the recorded image is used for the meter panel.

In the primary fixing step, the plural toner layers provided on the surface of the substrate 1 electrophotographically in the toner layer forming step are primarily fixed.

The substrate 1 usable in the invention is required to be transparent. "Transparent" as used herein refers to a property capable of transmitting lights in the visible region to a certain extent. A substrate that is transparent at least to such an extent that a formed image can be recognized through the substrate 1 with the naked eye is usable in the invention as a "transparent" substrate.

Plastic films are typically used as the substrate 1. These include light transmitting films usable for OHP such as an acetate film, a cellulose triacetate film, nylon film, polyester film, polycarbonate film, polystyrene film, polyphenylene sulfide film, polypropylene film, polyimide film and cellophane. The polyester film is frequently used at present from general point of views including mechanical, electrical, physical and chemical properties and processibility. A biaxially stretched polyethylene terephthalate (PET) film is frequently used among them.

A transparent resin and transparent ceramic may be used as the substrate 1 as well as the plastic films exemplified above. Pigments and dyes may be added therein. The substrate 1 may be a film or plate, and may be thick enough to lose its flexibility, or enough to have a strength required for the substrate 1.

The substrate 1 used in the invention is preferably a plastic film having a thickness in the range of 50 to 200 $\mu$m, and more preferably a PET film having a thickness in the range of 80 to 200 $\mu$m.

In the invention, a plurality of toner layers are laminated electrophotographically on the surface of the substrate 1 (in the invention, local existence of monolayer portion is permitted providing the toner layers are laminated in the image portion as a whole). The electrophotographic formation of toner layers is achieved by the following processes.

An example of the processes comprises:

uniformly charging the surfaces of the electrophotographic photosensitive materials of the toner image forming parts 14W, 14K1, 14R and 14K2 disposed in the image forming apparatus 10 in FIG. 2;

forming electrostatic latent images on the surfaces by exposing the surfaces to image-wise lights corresponding to image information feeding toner from a development device to the electrostatic latent images on the surfaces of the electrophotographic photosensitive materials to allow the electrostatic latent images to be developed to visible images by the toner to form a toner image; and transferring the formed toner images to the substrate 1 directly or via an intermediate transfer member, to form the plural toner layers. In the image forming apparatus 10 shown in FIG. 2, the toner images are sequentially transferred from the toner image forming parts 14W, 14K1, 14R and 14K2 onto the surface of the intermediate transfer member 40. The plural toner layers laminated on the surface of the intermediate transfer member 40 are transferred onto the surface of the substrate 1 at a secondary transfer part 44, and the plural toner layers which are inversions of the above toner layers are provided on the surface of the substrate 1.

When a full-color image is formed, the development processes each for one of four colors of yellow, magenta, cyan and black are proceeded separately. Each color image is directly fixed on the substrate 1 by sequentially laminating the color toner images (toner layers) on the substrate 1, or is fixed on the substrate 1 after sequentially laminating the color toner images on the intermediate transfer member.

Development of a certain amount of the black toner is required at a portion requiring a light screening property (light screening portion) in the image-recorded medium of the invention. However, since the amount of the color-K toner that can be developed in single development is restricted when the four colors toners of Y (yellow), C (cyan), M (magenta) and K (black) are used as described above, sufficient light impermeable property cannot be secured. Accordingly, it is preferable to form the toner image comprising two color-K toner layers by developing the color-K twice, instead of developing respective four colors of Y, C, M and K individually, in order to secure the light screening property of the light impermeable portion (light screening portion) by forming a sufficient amount of color-K toner layer on the substrate 1.

Since white color is often used in the image portion (light transmission portion) of the automobile display panel, the uppermost surface layer of the laminated plural toner layers should be a white toner layer when an image is formed on the automobile display panel. Furthermore, color reproducibility when an image is viewed from the backside of the substrate 1 may be improved by forming the uppermost surface layer with the white toner layer. Considering such advantages, it is preferable that the uppermost surface layer of the toner layer is a layer comprising the white toner.

Four toner image forming portions of W (white) 14W, K (black) 14K1, R (red) 14R and K (black) 14K2 colors are provided along the belt-shaped intermediate transfer member 40 in the image forming apparatus 10 in FIG. 2 considering the situations above. Primary transfer is repeated by running the intermediate transfer member 40, and primary transfer image 5 are formed on the surface of the intermediate transfer member 40. The primary transfer image 5 is transferred onto the surface of the substrate 1 by secondary transfer part 44, and secondary transfer images 6 are formed on the surface of the substrate 1.

The secondary transfer image 6 is composed of the toner layers having the reverse lamination sequence to that of the toner layers of the primary transfer image 5. The portion 7 on which the toner layers are sequentially laminated in the order of K, K and W from the surface of the substrate 1 finally serves as a light screening portion, while the portion 8 on which one toner layer of W or R is formed finally serves as the light transmission portion (letter portion). This means that in the toner image (fixed image) of the invention, any portion of the toner image may be composed of multiple toner layers, or some portions of the toner image may be composed of a monolayer of the toner.

Although in the invention, the plural toner layers are laminated in the order of lamination (the order of transfer) of W, K, R and K by using each development cartridge, the order of the three cartridges except the cartridge W can be arbitrarily selected so long as the cartridge W is placed at the first by the reasons as described above.

The method for forming the toner layers electrophotographically is not particularly restricted, and methods, production processes, apparatus and means known in the art as the electrophotographic techniques may be employed without any problems.

The electrophotographic toner used in the invention comprises a binding resin and coloring agent as main components.

Examples of the binding resin used for the toner include homopolymers or copolymers of:

styrenes such as styrene and chlorostyrene;

monoolefins such as ethylene, propylene, butylene and isobutylene;

vinyl esters such as vinyl acetate, vinyl propionate, vinyl benzoate and vinyl acetate;

α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate;

vinyl ethers such as vinylmethyl ether, vinylethyl ether and vinylbutyl ether; and vinyl ketones such as vinylmethyl ketone, vinylhexyl ketone and vinylisopropenyl ketone. Examples of the representative binding resins include polystyrene, styrene-acrylic ester copolymers, styrene-methacrylic ester acid copolymers, styrene-acrylonitrile copolymers, styrene-butadiene copolymers, styrene-maleic anhydride copolymers, polyethylene and polypropylene.

Additional examples of the binding resin include polyester, polyurethane, epoxy resins, silicone resins, polyamide, modified rosins, paraffin and wax. Polyester is particularly suitable as the binding resin among the resins above. The polyester resin used in the invention is synthesized by polycondensation of a polyol component and an acid component. Examples of the polyol component include ethyleneglycol, propyleneglycol, 1,3-butanediol, 1,4-butanediol, 2,3-butanediol, diethylene glycol, triethylene glycol, 1,5-butanediol, 1,6-hexanediol, neopentyl glycol, cyclohexane dimethanol, bisphenol A/ethylene oxide adducts, and bisphenol A/propylene oxide adducts.

Examples of the acid component include maleic acid, fumaric acid, phthalic acid, isophthalic acid, terephthalic acid, succinic acid, dodecenyl succinic acid, trimellitic acid, pyrromellitic acid, cyclohexane tricarboxylic acid, 1,5-cyclohexane dicarboxylic acid, 2,5,7-naphthalene tricarboxylic acid, 1,2,4-naphthalene tricarboxylic acid, 1,2,5-hexane tricarboxylic acid and 1,3-dicarboxyl-2-methylenecarboxypropane tetramethylene carboxylic acid, and anhydrides thereof. A plurality of resins selected from the resins above may be blended.

While representative examples of the representative coloring agents include carbon black as a black coloring agent; C.I. pigment red 48:1, C.I. pigment red 122, and C.I. pigment red 57:1 as magenta coloring agents; C.I. pigment yellow 97, C.I. pigment yellow 12, and C.I. pigment yellow 180 as yellow coloring agents; and C.I. pigment blue 15:1 and C.I. pigment blue 15:3 as cyan coloring agents, the coloring agents are not restricted thereto.

Coloring agents used for the magenta color and yellow color may be appropriately mixed for use as the red toner.

While the examples of the white coloring agent include titanium oxide, silica, tin oxide, aluminum oxide and magnesium oxide, titanium oxide is preferable from the viewpoint of the light resistance. While rutile type, anatase type and brookite type titanium oxides are known as titanium oxide, rutile type titanium oxide is preferable from the viewpoint of the screening property. The surface of titanium oxide is preferably surface-treated with alumina or silica in order to improve the light resistance.

The red and white toners used in the image portion (light transmission portion) is required to be transparent to a certain extent for display by back-light illumination, and this portion is required to have a transmission density of 0.1 to 1, preferably 0.3 to 0.7. Accordingly, the content of the coloring agent in the toner is preferably in the range of 4 to 40% by mass, more preferably in the range of 6 to 35% by mass. The transferred mass per area of the toner on the surface of the substrate (TMA) 10 at the light transmission portion is preferably in the range of 1.2 to 2.0 mg/cm$^2$.

On the other hand, the black toner used in the background portion (light screening portion) is required to have a light screening property with a transmission density of 3.5 or more. The content of carbon black as the coloring agent may be increased, or TMA of the black toner may be increased for increasing the transmission density. However, since carbon black is conductive, the electrical resistance of the toner decreases when the content of carbon black in the toner is too high, to cause fogging and scattering of the toner due to decreased electrification of the toner.

Since the resistance of the developer decreases, the carrier itself is also developed to cause Bead Carry Over (BCO). When TMA is too high, on the other hand, the image is poorly transferred to the substrate 10 to generate uneven images. Accordingly, the content of carbon black is in the range of 4 to 15% by mass, and TMA of the black toner is preferably in the range of 1.2 to 2.0 mg/cm$^2$, for satisfying a transmission density of 3.5 or more without causing fogging, scattering of the toner, BCO and uneven images. TMA of the light screening portion is preferably in the range of 1.2 to 3.0 mg/cm$^2$.

The electrophotographic toner used in the invention may contain additives such as an electrification control agent and wax, if desired. Examples of the electrification control agent include azo base metal complexes, and metal complexes or metal salts of salicylic acid or alkylsalicylic acid. The waxes usable include olefin waxes such as low molecular weight polyethylene and low molecular weight polypropylene, plant waxes such as carnaubau, animal waxes and inorganic waxes.

While the method for producing the electrophotographic toner used in the invention is not particularly restricted, for example, a melt-pulverization method is preferable. According to the melt-pulverization method, various toner materials as described above are mixed with a Banbury mixer, Nyder coater, continuous mixer and extruder, and melt-kneaded, pulverized and classified to produce toner. The volume average particle diameter of the toner is 30 μm or less, preferably in the range of 4 to 20 μm.

A fluidizing agent may be further added in the electrophotographic toner used in the invention as a separate component. Examples of the fluidizing agent include silica, titanium oxide and aluminum oxide.

The electrophotographic toner used in the invention may be used as a two-component developer by mixing with an appropriate carrier. Any carrier known in the art may be used. For example, the carriers usable include ferrite, magnetite and iron powders, and the surface thereof may be coated with a resin such as a styrene resin, fluorinated resin, silicone resin or epoxy resin. It is possible to use the carrier as a semiconductive or conductive carrier by adding a conductive powder such as carbon black or a metal oxide powder to the coating resin. The volume average particle diameter of the carrier is usually adjusted in the range of 20 to 100 μm.

The mass mixing ratio of the toner in the two-component developer controls the amount of electrification of the toner, determines the upper limit of the amount of the developing toner, and is an important factor that determines TMA. The mixing ratio is adjusted in the range of 2 to 12% by mass in the invention. Desired TMA cannot be easily obtained when the mixing ratio is smaller than 2% by mass, since the amount of electrification becomes too high or the upper limit of the amount of the developing toner becomes small. Fogging and scattering of the toner are sometimes easily occur when the mixing ratio is larger than 12% by mass since the electrification quantity is too low.

In the plural toner layer formed on the surface of the substrate 1 in the image forming apparatus 10 in the image forming method of the invention, among the toner layers constituting the secondary transfer image 6 formed on the surface of the substrate 1, only the layer in the vicinity of the upper most surface is subjected to primary fixing (temporary fixing) with a fixing device 20, and the entire toner layer is subjected to secondary fixing in a non-contact manner in an oven as shown in FIG. 2, in order to prevent blisters.

Primary Fixing Step

The toner constituting the secondary transfer image 6 is melted and fixed with the fixing device 20 integrated in the image forming apparatus 10 in the primary fixing step of the secondary transfer image 6 formed on the surface of the substrate 1. The toner may be fixed by using a roll-type fixing device or a belt-type fixing device.

In the primary fixing step, only the toner forming the uppermost surface of the secondary transfer image 6 is temporarily fixed to such an extent that image slippage is prevented, in order to prevent blisters in the fixing step. For this purpose, the primary fixing temperature T1 is preferably such a temperature that toner in the vicinity of the surface of the toner layer is heated to a temperature around the melting point of the toner. Specifically, T1 is preferably from 100 to 145° C. "The primary fixing temperature" refers to the surface temperature of a fixing member such as a fixing roll.

Secondary Fixing Step

Figures 3A, 3B, 3C, 3D:
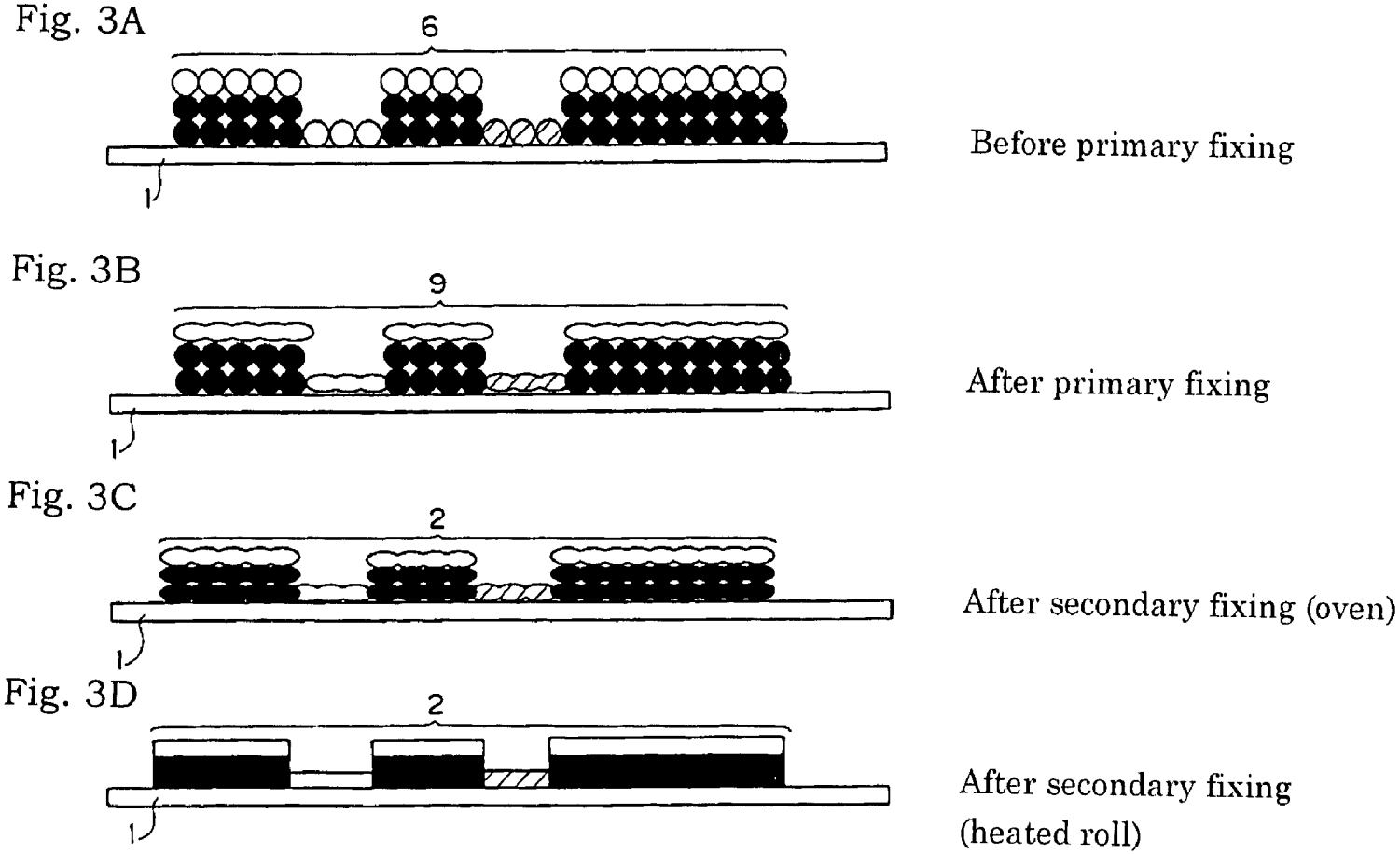
FIGS. 3A to 3D are schematic views showing the cross section of the plural toner layers before fixing, and the cross section of the toner structures after fixing.

FIGS. 3A to 3D illustrates the differences in the toner structures before and after the primary fixing, and after the secondary fixing. While only the toner in the uppermost layer is slightly deformed after the primary fixing as shown in FIG. 3B, the toner in the lower layers thereof is hardly deformed with substantial spaces among the toner particles. Accordingly, small spaces are left behind after the lower toner layers are fixed as shown in FIG. 3C when the primary fixed image 9 is directly subjected to secondary fixing, and the air confined in the space eventually causes voids later.

Accordingly, in the invention, the secondary fixing step is carried out under reduced pressure. By proceeding the secondary fixing under reduced pressure, the spaces among the toner particles generated after the secondary fixing are prevented from developing into image defects such as voids, since no air is left in the spaces.

The toner layer may be heated at a prescribed temperature under atmospheric pressure to reduce the space in the toner layer, before fixed under reduced pressure. Since the amount of air remaining in the toner layer is reduced by heating under atmospheric pressure, the fixing temperature, fixing time and the degree of the pressure reduction may be reduced in the secondary fixing under reduced pressure. Consequently, the image damages caused by boiling, evaporation and foaming of the toner component can be reduced.

The toner is preferably heated in a non-contact manner in an oven under atmospheric pressure. The heating temperature is preferably in the range of 80 to 140° C., more preferably in the range of 100 to 120° C.

The degree of vacuum of the reduced pressure is preferably $1\times10^4$ Pa or less, more preferably $2\times10^3$ Pa or less. If the degree of vacuum is out of the range, voids may be generated when the image-recorded medium is used at high temperatures.

The secondary fixing step is performed by melting the primary fixed image under the reduced pressure. According to the invention, the primary image is preferably fixed in a non-contact manner such as heating in an oven in order to prevent quality deterioration caused by contact with the fixing member. The temperature in the oven is preferably such a temperature that the toner particles are fluidized to fill the voids. Specifically, the temperature is preferably in the range of 100 to 140° C., and the heating time is preferably 1 to 60 minutes.

The primary fixed image is subjected to secondary fixing preferably by passing the primary fixed image through a nip between a pair of heated rolls 32 under the reduced pressure from the viewpoint of eliminating most of the voids present in the fixed image by the secondary fixing step. When such heated rolls are used, the temperature of the heated roll is preferably a temperature such that the entire toner layers are heated to at least the meeting point of the toner; specifically, a temperature range of 120 to 170° C. is preferable.

FIGS. 3C and 3D illustrate enlarged cross sections of the fixed image 2 after the secondary fixing. When the secondary fixing is performed by using the heated roll, voids among the toners in the fixed image are greatly reduced as shown in FIG. 3D, as compared with the fixed image 2 which has been subjected to secondary fixing in the oven as shown in FIG. 3C. In fact, voids are hardly observable in the fixed image 2 in FIG. 3D. By using the heated rolls at the secondary fixing, the toner structure, which has higher reliability than the fixed image 2 obtained by using the oven at the secondary fixing, can be obtained. Since no spaces among the toners remain, the toner is less likely to be fluidized by heating; moreover the transmission density of the image is improved.

<Image-recorded Medium>

The image-recorded medium of the invention is obtained by laminating the surface of the substrate on which the fixed image is formed with a laminate film, wherein the fixed image is formed by the image forming method of the invention.

As described above, the image-recorded medium of the invention comprises the substrate 1, the fixed image 2 fixed on the substrate 1, and the laminate film 3 covering the fixed image shown in FIG. 1.

When the substrate 1 on which the fixed image 2 is formed is used, for example, for the automobile meter panel, the fixed image 2 is fluidized at the temperature in the cabin that may rise to about 80 to 100° C. Consequently, in the image-recorded medium of the invention, the fixed image 2 is laminated with a transparent laminate film 3 for protecting the fixed image 2 (a lamination step).

In the lamination step, the transparent laminate film 3 is contact-bonded onto the surface of the substrate 1 on which the fixed image 2 is formed.

The laminate film 3 usable includes the film having the same quality as the substrate 1 as well as vinyl chloride, vinylidene chloride and polyester films.

According to the invention, as shown in FIG. 1, the laminate sheet 3 preferably comprises an adhesive layer 3*b* on the face of the laminate sheet 3*a* facing the fixed image 2 composed of the materials above, so as to enhance the contact characteristics of the laminate film 3 with the fixed image 2 and the substrate 1.

Examples of the adhesive used for the adhesive layer 3*b* include polyester, isocyanate, vinylether polymer, polyisobutylene and polyisoprene based adhesives. Conventionally used methods such as blade coating method, wire-bar coating method, spray coating method, dip coating method, beads coating method, air-knife coating method, curtain coating method and roll coating method may be employed as the method for coating the adhesive on the surface of the laminate film.

The thickness of the laminate sheet 3*a* is preferably in the range of 10 to 200 μm, more preferably in the range of 25 to 75 μm, in consideration of fusing property, handling property and strength. The thickness of the adhesive layer 3*b* is preferably in the range of 10 to 100 μm, more preferably in the range of 20 to 50 μm, in consideration of the ability of bonding by absorbing the surface roughness of the image.

A function control layer having a function of controlling glossness, light fastness, fire retarding property, releasing property and antistatic property may be provided on the face of the laminate sheet 3*a* opposite to the face facing the fixed image 2.

The method for contact-bonding the laminate film 3 is not particularly restricted, and conventionally known various lamination methods and lamination apparatus may be favorably used. For example, the laminate film 3 may be contact-bonded to the fixed image 2 and the substrate 1 by a conventional lamination method and lamination apparatus, in which:

the laminate film 3 is stacked the substrate 1; then the substrate 1 and the laminate film 3 are slightly melted to be fused by allowing the substrate 1 and the laminate film 3 to pass through a nip between a pair of the heated-rolls.

The image-recorded medium of the invention is formed into a panel member in the panel cutting step as shown in FIG. 2, and is used for making a final product such as an automobile panel meter in the panel assembling step.

EXAMPLES

While the invention is described in detail with reference to examples, the invention is by no means restricted to these examples.

Example 1

<Preparation of Substrate>

Preparation of Coating Solution for Grossness Control Layer

Into 100 parts by mass of butyl alcohol, 10 parts by mass of polyvinyl butyral (BM-S made by Sekisui Chemical Co., Ltd.) as a heat-meltable resin, 15 parts by mass of polymethyl methacrylate fine particles (MP-1451 made by Soken Chemical & Engineering Co., Ltd., volume average particle diameter: 0.1 μm) as a filler, and 0.5 parts by mass of a charge control agent (Elegan WAX made by Nippon Oil & Fats Co., Ltd.) were added. The mixture was then thoroughly stirred with a homomixer to prepare coating solution A for the glossness control layer.

Preparation of Image Receiving Layer Coating Solution

Coating solution B for the image receiving layer was prepared using the same composition as in the coating solution A for the glossness control layer, except that the filler was eliminated and 0.05 parts by mass of cross-linked polymethyl methacrylate fine particles (MP-150 made by Soken Chemical & Engineering Co., volume average particle diameter: 5 μm) were added.

Production of Substrate

The coating solution A for the glossness control layer was coated on a PET film (Lumirror 125T60 by Panac Co., Ltd.) with a thickness of 125 μm so that the coated amount of the coating solution A became 30 g/m$^2$, and a glossness control layer with a thickness of 2 μm was formed after drying at 130° C. for 10 minutes. The coating solution B for the image receiving layer was also coated on the face opposite to the face provided with the glossness control layer to form an image receiving layer with a thickness of 2 μm by the same method as that used for coating the coating solution A.

<Preparation of Image-Recorded Medium>

An image was formed on the substrate using Color Docutech 60 (made by Fuji Xerox Co., Ltd.), which is an electrophotographic image forming apparatus. The image information to be formed was an automobile mater panel, and the image had a highlighted warning lamp portion. The toner colors used for four development units (toner image forming portions) were W, K, R and K (this order corresponding to the transfer order at the primary transfer), and the fixing temperature in the fixing device (primary fixing step) was 140° C.

TMA of the laminated toner layers (light screening portion) before fixing was 2.3 mg/cm$^2$.

The substrate on which the primary fixed image is formed by the image forming apparatus was placed in a vacuum oven, and the primary fixed image was subjected to the secondary fixing in a non-contact manner.

On the other hand, a laminate film was prepared by coating vinylether polymer on one face of a transparent laminate sheet (material: polyethylene terephthalate (PET), A4 size, thickness: 100 μm) with a thickness of 30 μm as an adhesive layer. The laminate sheet was attached to the substrate so that the adhesive layer faces the face of the substrate holding the fixed image. An image-recorded medium was prepared by allowing the laminated substrate to pass through a nip between a pair of heated rolls which are heated to 100° C.

The image on the image-recorded medium obtained had a transmission density of 3.6 at the light screening portion, and exhibited a high image quality without image defects such as inferior graininess and visible dots. The transmission density was measured by using a transmission densitometer (model 341) made by X-Rite Co.

<Evaluation of Image-recorded Medium>

The image-recorded medium prepared as described above was set on a light table with the laminated face facing the rear side, and illuminated with a fluorescent lamp from the rear side. No pin-holes transmitting the light of the fluorescent lamp were observed with the naked eye.

The image-recorded medium was placed in the oven again, and was subjected to an endurance test corresponding to an endurance test for several years at an automobile cabin temperature of 80 to 100° C., which is a supposed temperature range at midsummer. The image-recorded medium after the endurance test was also conducted as described above. As the result, no voids that transmit the light of the fluorescent lamp were found, and the good image was still maintained.

Example 2

A primary fixed image was formed on the surface of the substrate by the same method as in Example 1. The image was subjected to the secondary fixing by a roll type vacuum laminator (HLM-V570 made by Hitachi Chemical Co., Ltd.), in which the image was allowed to pass through the nip between a pair of heated rolls which are heated to 150° C. in a vacuum chamber evacuated to $5\times10^3$ Pa.

The substrate holding the image thereon after the secondary fixing was laminated as in Example 1 to produce an image-recorded medium.

The image on the image-recorded medium obtained had a transmission density of 3.7 at the light screening portion. The quality of the image was excellent without image defects such as inferior graininess and visible dots.

The heat resistance of the image is assessed as in Example 1. As the result, no voids that transmit the light of the fluorescent lamp were found, and the good image was maintained.

Example 3

A primary fixing image was formed on the surface of the substrate by the same method as in Example 1. The substrate was placed in an oven kept at 100° C. under atmospheric pressure, and the image was subjected to the secondary fixing for 10 minutes. Subsequently, the substrate was placed in a vacuum oven, and the image was subjected to the secondary fixing in a non-contact manner to fix the primary fixed image. The substrate was laminated thereafter by the same method as in Example 1 to produce an image-recorded medium.

The image on the image-recorded medium obtained had a transmission density of 3.7 at the light screening portion. The quality of the image was excellent without image defects such as inferior graininess and visible dots.

The heat resistance of the image is assessed as in Example 1. As the result, no voids that transmit the light of the fluorescent lamp were found, and the good image was maintained.

Comparative Example 1

An image-recorded medium was prepared by the same method as in Example 1, except that the secondary fixing step was conducted under atmospheric pressure, and the image-recorded medium was evaluated by the same method as in example 1.

While no pin-holes were observed with the naked eye at the initial state in the image-recorded medium prepared, generation of voids were observed after the heat resistance test.

As shown in the results above, the toner layer was almost completely degassed by conducting the secondary fixing under reduced pressure in the examples according to the invention. Accordingly, the image on the completed meter panel had sufficient heat resistance for preventing the fluidization of the toner caused by expansion of air in the meter panel. This means that the generation of voids was substantially prevented.

The invention provides an image forming method for producing an image having both characteristics of light screening property and light transmitting property and reliability at high-temperature environment, such as an automobile meter panel. The invention also provides an image-recorded medium holding highly reliable recorded images.

What is claimed is:

1. An image forming method comprising:

laminating a plurality of toner layers on a surface of a transparent substrate electrophotographically;

fixing the plural toner layers to the surface of the transparent substrate in a primary fixing step; and fixing the primarily fixed plural toner layers in a secondary fixing step under lower atmospheric pressure than the primary fixing step.

2. An image forming method according to claim 1, wherein the secondary fixing step is carried out in a non-contact manner.

3. An image forming method according to claim 1, wherein the secondary fixing step is carried out at 100 to 140° C.

4. An image forming method according to claim 1, wherein the plural toner layers are heated under atmospheric pressure before the secondary fixing under reduced atmospheric pressure in the secondary fixing step is carried out.

5. An image forming method according to claim 4, wherein the plural toner layers are heated in a non-contact manner in an oven.

6. An image forming method according to claim 4, wherein the plural toner layers are heated at 80 to 140° C.

7. An image forming method according to claim 1, wherein the primary fixing step is carried out at a primary fixing temperature of 100 to 145° C.

8. An image-recorded medium formed by the steps comprising:

laminating a plurality of toner layers on a surface of a transparent substrate electrophotographically;

fixing the plural toner layers to form a fixed image; and laminating the fixed image with a transparent laminate film, wherein the fixed image is formed by the image forming method according to claim 1.

9. An image forming method comprising:

laminating a plurality of toner layers on a surface of a transparent substrate electrophotographically;

fixing the plural toner layers to the surface of the transparent substrate as a primary fixing step; and fixing the primarily fixed plural toner layers in a secondary fixing step under reduced pressure using heated rolls.

10. An image forming method according to claim 9, wherein a temperature of the heated rolls in the secondary fixing step is from 120 to 170° C.

11. An image forming method comprising:

laminating a plurality of toner layers on a surface of a transparent substrate electrophotographically;

fixing the plural toner layers to the surface of the transparent substrate as a primary fixing step; and fixing the primarily fixed plural toner layers in a secondary fixing step under reduced pressure, wherein a degree of vacuum of the reduced pressure is no more than $1\times10^4$ Pa.

12. An image forming method according to claim 11, wherein the secondary fixing step is carried out in a non-contact manner.

13. An image forming method according to claim 11, wherein the secondary fixing step is carried out at 100 to 140° C.

14. An image forming method according to claim 11, wherein the secondary fixing step is carried out by using heated rolls.

15. An image forming method according to claim 14, wherein a temperature of the heated rolls in the secondary fixing step is from 120 to 170° C.

16. An image forming method according to claim 11, wherein the plural toner layers are heated under atmospheric pressure before the secondary fixing under reduced pressure in the secondary fixing step is carried out.

17. An image forming method according to claim 16, wherein the toner layers are heated in a non-contact manner in an oven.

18. An image forming method according to claim 16, wherein the toner layers are heated at 80 to 140° C.

19. An image forming method according to claim 11, wherein the primary fixing step is carried out at a primary fixing temperature of 100 to 145° C.

20. An image-recorded medium produced by laminating a plurality of toner layers on a surface of a transparent substrate electrophotographically;

fixing the plural toner layers to form a fixed image; and laminating the fixed image with a transparent laminate film, wherein the fixed image is formed by the image forming method according to claim 11.

* * * * *